US009816466B2

(12) United States Patent
Roth et al.

(10) Patent No.: US 9,816,466 B2
(45) Date of Patent: Nov. 14, 2017

(54) CONDENSING EGR-MIXER SYSTEM

(71) Applicant: BorgWarner Inc., Auburn Hills, MI (US)

(72) Inventors: David B. Roth, Groton, NY (US); Robert Czarnowski, Oxford, MI (US); Christopher Thomas, Commerce, MI (US); Timm Kiener, Lake Orion, MI (US); Thomas Auer, Gries am Brenner (AT)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 15/035,326

(22) PCT Filed: Jul. 29, 2014

(86) PCT No.: PCT/US2014/048526
§ 371 (c)(1),
(2) Date: May 9, 2016

(87) PCT Pub. No.: WO2015/069330
PCT Pub. Date: May 14, 2015

(65) Prior Publication Data

US 2016/0281650 A1 Sep. 29, 2016

Related U.S. Application Data

(60) Provisional application No. 61/902,535, filed on Nov. 11, 2013.

(51) Int. Cl.
*F02B 33/44* (2006.01)
*F02M 26/35* (2016.01)
(Continued)

(52) U.S. Cl.
CPC ..... *F02M 26/35* (2016.02); *F02M 26/03* (2016.02); *F02M 26/19* (2016.02)

(58) Field of Classification Search
CPC combination set(s) only.
See application file for complete search history.

(56) References Cited

U.S. PATENT DOCUMENTS 6,044,827 A * 4/2000 Pfaff ..... F02B 47/08 123/568.18
6,301,887 B1 10/2001 Gorel et al.
(Continued)

FOREIGN PATENT DOCUMENTS

EP 2050949 A1 4/2009
EP 2202402 A2 6/2010

OTHER PUBLICATIONS

International Search Report and Written Opinion ;dated Nov. 19, 2014; for International Application No. PCT/US2014/048526; 16 pages.

*Primary Examiner* — Jesse Bogue
(74) *Attorney, Agent, or Firm* — BrooksGroup

(57) ABSTRACT

An EGR-mixer system may include an exhaust gas recirculation valve and a venturi mixer. The venturi mixer may be constructed and arranged to facilitate condensation of water out of exhaust gas and/or intake air entering the EGR-mixer system after which the condensate may be collected and the exhaust gas and/or intake air may flow through the EGR-mixer system.

22 Claims, 1 Drawing Sheet

(51) Int. Cl.
*F02M 26/19* (2016.01)
*F02M 26/03* (2016.01)

(56) References Cited

U.S. PATENT DOCUMENTS

| | | | | |
|---|---|---|---|---|
| 7,322,193 | B2 | 1/2008 | Bering et al. | |
| 7,451,750 | B1 * | 11/2008 | Fox | F02B 29/0468 123/568.12 |
| 8,015,809 | B2 * | 9/2011 | Watson | F01N 3/005 123/25 A |
| 8,960,166 | B2 * | 2/2015 | Styles | F02M 31/042 123/552 |
| 9,382,836 | B2 * | 7/2016 | Maceroni | F02B 33/44 |
| 2004/0079079 | A1 * | 4/2004 | Martin | F01N 3/005 60/605.2 |
| 2006/0060172 | A1 * | 3/2006 | Liu | F02M 35/10118 123/568.17 |
| 2008/0022676 | A1 * | 1/2008 | Cook | F02B 29/0475 60/599 |
| 2008/0134678 | A1 * | 6/2008 | Noelle | F01D 25/24 60/605.2 |
| 2009/0071150 | A1 * | 3/2009 | Joergl | F02M 26/06 60/605.2 |
| 2010/0154758 | A1 * | 6/2010 | Schneider | G01F 1/44 123/568.12 |
| 2011/0011060 | A1 * | 1/2011 | McCarthy, Jr. | F01N 3/0814 60/274 |
| 2011/0030372 | A1 | 2/2011 | Ooshima et al. | |
| 2013/0133631 | A1 * | 5/2013 | Graze, Jr. | F02M 26/47 123/568.11 |
| 2013/0283786 | A1 * | 10/2013 | Muenz | F01D 9/026 60/605.1 |

* cited by examiner

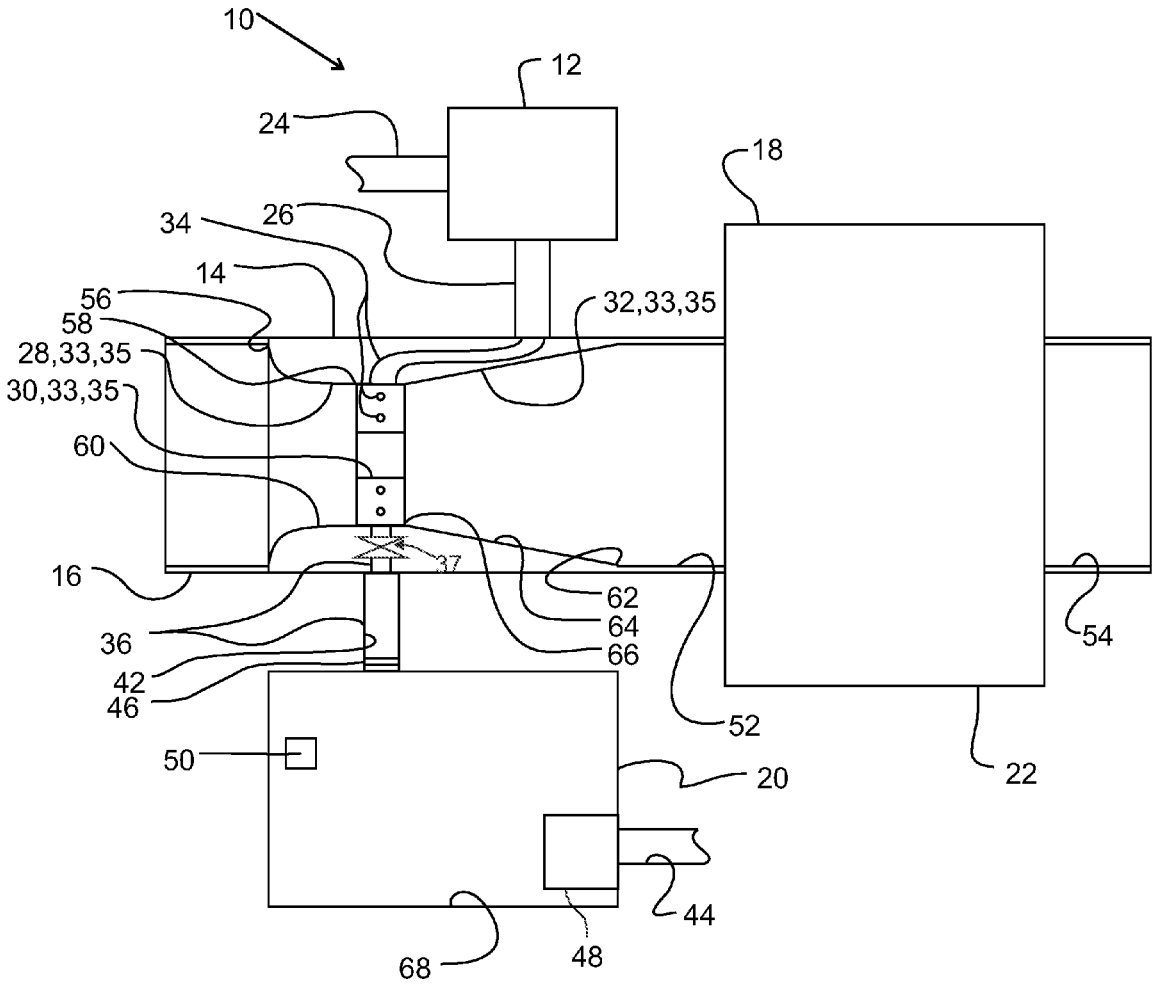
10
12
24
18
34
26
14
56
58
28,33,35
30,33,35
60
32,33,35
16
37
62
64
66
36
42
46
54
52
50
20
22
44
68
48

CONDENSING EGR-MIXER SYSTEM

CROSS-REFERENCE TO RELATED APPLICATIONS

This application claims the benefit of U.S. Provisional Application No. 61/902,535 filed Nov. 11, 2013.

TECHNICAL FIELD

The field to which the disclosure generally relates to includes exhaust gas recirculation systems.

BACKGROUND

Exhaust gas in motor vehicles often contains water vapor that may ultimately condense and form undesirable sludge or cause damage to components of the motor vehicle. Proper management of water vapor and condensation can reduce formation of sludge and prevent damage to motor vehicle systems and components.

SUMMARY OF ILLUSTRATIVE VARIATIONS OF THE INVENTION

One variation may include an EGR-mixer system that may include an exhaust gas recirculation (EGR) valve and a venturi mixer. The venturi mixer may be constructed and arranged to facilitate condensation of water out of exhaust gas and/or intake air entering the EGR-mixer system.

Another variation may include an EGR-mixer system that may include an air inlet, an EGR valve, a venturi mixer, a condensate reservoir, and an outlet. The inlet may be constructed and arranged to guide air entering the inlet into the venturi mixer, where the venturi mixer may be constructed and arranged to facilitate condensation of water out of exhaust gas and/or intake air entering the EGR-mixer system and into the condensate reservoir, and where the outlet may guide air out of the venturi mixer.

Yet another variation may include an EGR-mixer system that may include an air inlet, an EGR valve, a venturi mixer, a condensate reservoir, an outlet, and a compressor. The inlet may be constructed and arranged to guide air entering the inlet into the venturi mixer, where the venturi mixer may be constructed and arranged to facilitate condensation of water out of exhaust gas and/or intake air entering the EGR-mixer system and into the condensate reservoir, and where the outlet may guide air out of the venturi mixer and into a compressor. The condensate reservoir may be constructed and arranged to flow condensate through a plurality of components within the system to heat or cool the components as desired.

Other illustrative variations within the scope of the invention will become apparent from the detailed description provided hereinafter. It should be understood that the detailed description and specific examples, while disclosing variations within the scope of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein:

FIG. 1 illustrates a sectional view of an EGR-mixer system according to one variation.

DETAILED DESCRIPTION OF ILLUSTRATIVE VARIATIONS

The following description of variants is only illustrative of components, elements, acts, products, and methods considered to be within the scope of the inventions and are not in any way intended to limit such scope by what is specifically disclosed or not expressly set forth. The components, elements, acts, products, and methods as described herein may be combined and rearranged other than as expressly described herein and still are considered to be within the scope of the inventions.

Referring to FIG. 1, an exhaust gas recirculation (EGR) mixer (EGR-mixer) system 10 may include an EGR valve 12, a venturi mixer 14, an air intake 16, and an air outlet 18, a reservoir 20, and a compressor 22. The EGR-mixer system 10 may be constructed and arranged to facilitate the condensation of water from incoming air or exhaust gas or both.

The EGR valve 12 may have an inlet 24 where exhaust gas from a combustion engine (not shown) may through the EGR valve 12 and flow through an outlet 26. The outlet 26 may be a passage in fluid communication with the venturi mixer 14.

The venturi mixer 14 may include a converging inlet 28, a throat 30, a diverging outlet 32, an exhaust gas inlet 34, condensate outlet channels 36, heat transfer fins (not shown), and cooling channels (not shown). The converging inlet 28 may have a first circumference 56, a second circumference 58, and an entry cone portion 60, where the first circumference 56 may be larger than the second circumference 58 and the entry cone 60 may be constructed and arranged to gradually converge in the direction of fluid flow from the air intake system i.e. from the first circumference 56 to the second circumference 58. The diverging outlet 32 may have a first circumference 62, a second circumference 64, and an exit cone portion 66, where the first circumference 62 may be smaller than the second circumference 64 and the exit cone 66 may be constructed and arranged to gradually diverge in the direction of fluid flow from the air intake system i.e. from the first circumference 62 to the second circumference 64. The converging inlet 28 may be a passage in fluid communication with an air intake system (not shown) where the converging inlet 28 may gradually converge in the direction of fluid flow from the air intake system until structurally connecting to a throat 30. The throat 30 may be located at the narrowest end of the converging inlet 28. The throat 30 may be located between the converging inlet 28 and the diverging outlet 32, wherein the throat 30 may be constructed and arranged to allow fluid communication through the converging inlet 28 to the diverging outlet 32. The throat 30 may have a circumference equal to that of the second circumference 58 of the converging inlet 28 or the first circumference 62 of the diverging outlet 32, or both.

The venturi mixer 14 may also include a plurality of EGR inlet channels 34 in fluid communication with the outlet 26 of the EGR valve 12. According to one variation, the EGR inlet channels 34 may allow fluid communication between the outlet 26 of the EGR valve 12 and the converging inlet 28 of the venturi mixer 14. In another variation, the EGR inlet channels 34 may allow fluid communication between the outlet 26 of the EGR valve 12 and the throat 30 of the venturi mixer 14. In another variation, the EGR inlet channels 34 may allow fluid communication between the outlet 26 of the EGR valve 12 and the diverging outlet 32 of the venturi mixer 14.

The venturi mixer 14 may also include at least one condensate outlet channel 36 in fluid communication with a condensate reservoir 20. According to one variation, the least one condensate outlet channel 36 may allow fluid communication between the converging inlet 28 of the venturi mixer 14 and the reservoir 20. In another variation, the least one condensate outlet channel 36 may allow fluid communication between the throat 30 of the venturi mixer 14 and the reservoir 20. In another variation, the least one condensate outlet channel 36 may allow fluid communication between the diverging outlet 32 of the venturi mixer 14 and the reservoir 20. In another variation, the least one condensate outlet channel 36 may include a condensate outlet channel valve 37. In a number of variations, the condensate outlet channel valve 37 may be a float valve. In a number of variations, the float valve 37 may allow the venturi mixer 14 to drain condensate to the reservoir 20 when the EGR valve 12 and/or float valve 37 are open. In a number of variations, the condensate outlet channel valve 37 may be a check valve. In a number of variations, the check valve may allow the venturi mixer 14 to drain condensate to the reservoir 20 when the EGR valve 12 may be open and there is a vacuum in the air intake system. In a number of variations, the check valve 37 may be sized to limit the EGR flow through the condensate outlet channel 36, which may be plumbed to the air intake system to control EGR flow rate through the condensate outlet channel 36 to a predetermined percentage of the total EGR flow rate at the exhaust gas inlet channel 34, converging inlet 28, and/or EGR valve outlet 26. In a number of variations, this predetermined percentage may be controlled by a controller (not shown) and calibrated based on engine (not shown) or EGR-mixer system 10 conditions. In a number of variations, the venturi mixer 14 may deliver a mix of Low-Pressure-Loop exhaust gas and Mid-Pressure-Loop exhaust gas to the diverging outlet 32 of the venturi mixer 14. In a number of variations, this may limit the EGR-fouling in the compressor 22 and charge air cooler which may be in in the cooling channels (not shown) when the engine (not shown) operates at low-load. In a number of variations, the condensate outlet channel valve 37 may be a Positive Crankcase Ventilation (PCV) valve. In a number of variations the PCV valve 37 may be a combination check valve and flow regulation valve. In a number of variations the PCV valve 37 may be connected to the air intake system. In a number of variations, the PCV valve may be connected to the air intake system at the first circumference 56 or second circumference 58. In a number of variations, the condensate outlet channel may include a condensate outlet channel filter 39. In a number of variations, the condensate outlet channel filter 39 may include a filter or screen that may trap particle matter that may become dislodged from the catalytic converter (not shown).

The venturi mixer 14 may also include at least one heat transfer fin 35 constructed and arranged to function as a passive heat exchanger. The at least one heat transfer fin may be located within the converging inlet 28, the throat 30, or the diverging outlet 32, or any combination of the converging inlet 28, throat 30, and diverging outlet 32. The venturi mixer 14 may also include at least one cooling channel 33 constructed and arranged to function as an active heat exchanger. The at least one cooling channel may be located within the converging inlet 28, the throat 30, or the diverging outlet 32, or any combination of the converging inlet 28, throat 30, and diverging outlet 32. A cooling fluid may be flown through the at least one cooling channel to cool the venturi mixer 14.

The venturi mixer 14 may be constructed and arranged to facilitate the condensation of water from incoming air or exhaust gas or both wherein the converging inlet 28 and the EGR valve 12 may be constructed and arranged to flow air and exhaust gas into the venturi mixer 14, and wherein the air and exhaust gas may mix and flow from the converging inlet 28 through the throat 30 and through the diverging outlet 32 causing moisture within the air and exhaust gas mixture to condensate and fall out of the air and exhaust gas mixture.

The condensate reservoir 20 may have an inlet 42, an outlet 44, a filter 46, a pump 48, a fluid reservoir 68, and a water level sensor 50. The inlet 42 may be in fluid communication with the at least one condensate outlet channel 36 of the venturi mixer 14. The fluid reservoir 68 may be constructed and arranged to contain and hold condensate or other fluids. In one variation, condensate flowing from the venturi mixer 14, through the at least one condensate outlet channel 36, and into the inlet 42 may be collected in the fluid reservoir 68. In another variation, the pump 48 may be constructed and arranged to flow condensate from the fluid reservoir 68 through the outlet 44 and into the at least one cooling channel of the venturi mixer 14. The filter 46 may be located within the inlet 42, the outlet 44, or anywhere within the fluid reservoir 68 and may be constructed and arranged to filter particulate from incoming or outgoing fluid or condensate. The water level sensor 50 may be constructed and arranged to monitor fluid or condensate levels within the fluid reservoir 68.

The compressor 22 may have an inlet 52 and an outlet 54. The inlet 52 may be in fluid communication with the diverging outlet 32 of the venturi mixer 14, and the outlet 54 may be in fluid communication and a combustion engine (not shown). The compressor 22 may be constructed and arranged to flow fluid from the venturi mixer 14 to a combustion engine.

FIG. 1 is only one illustrative variation and it should be understood that discloses optional variations of the invention and is intended for purposes of illustration only and is not intended to limit the scope of the invention According to a first variation, an EGR-mixer system may include a venturi mixer that may include a converging inlet, a throat, and a diverging outlet, and where the converging inlet, throat, and diverging outlet may define a through-channel within the venturi mixer and where the venturi mixer may be constructed and arranged to facilitate the mixing of incoming exhaust gas flow and incoming air flow to create an exhaust gas and air mixture that flows through the through-channel and to facilitate condensation of liquid from the exhaust gas and air mixture as said mixtures flows through the through-channel of the venturi mixer.

A second variation may include an EGR-mixer system as set forth in the first variation where the converging inlet may converge at an angle ranging from about 1 degree to about 30 degrees relative to a longitudinal axis of the through-channel and where the diverging inlet may diverge at an angle ranging from about 1 degree to about 9 degrees relative to the longitudinal axis of the through-channel.

A third variation may include an EGR-mixer system as set forth in the first or second variations where the EGR-mixer system may further include a reservoir, the reservoir that may include an inlet, a fluid reservoir, and a pump. The reservoir may be constructed and arranged to receive condensate from the venturi mixer and may flow said condensate to at least one portion of a motor vehicle to actively cool or heat that portion of the motor vehicle.

A fourth variation may include an EGR-mixer system as set forth in the first through third variations where the venturi mixer may further include at least one exhaust gas inlet channel that may be constructed and arranged to facilitate the mixing of incoming exhaust gas flow and incoming air flow to create an exhaust gas and air mixture.

A fifth variation may include an EGR-mixer system as set forth in the first through fourth variations where the venturi mixer may further include at least one heat transfer fin that may be constructed and arranged to facilitate passive cooling of the venturi mixer and condensation of liquid from the exhaust gas and air mixture as said mixture flows through the through-channel of the venturi mixer.

A sixth variation may include an EGR-mixer system as set forth in the first through fifth variations where the venturi mixer may further include at least one cooling channel that may be constructed and arranged to facilitate active cooling of the venturi mixer and condensation of liquid from the exhaust gas and air mixture as said mixtures flows through the through-channel of the venturi mixer.

A seventh variation may include an EGR-mixer system as set forth in the third variation where the venturi mixer may further include at least one cooling channel and the reservoir may be constructed and arranged to receive condensate from the venturi mixer and flow said condensate to the at least one cooling channel constructed and arranged to facilitate active cooling of the venturi mixer.

An eighth variation may include an EGR-mixer system as set forth in the first through seventh variations where the converging inlet may include a first circumference, a second circumference, and an entry cone portion, where the first circumference may be larger than the second circumference and the entry cone may be constructed and arranged to gradually converge from the first circumference to the second circumference along the length of the entry cone. The diverging outlet may comprise a first circumference, a second circumference, and an exit cone portion, where the first circumference may be smaller than the second circumference and the exit cone may be constructed and arranged to gradually diverge from the first circumference to the second circumference along the length of the exit cone. The throat may be positioned between the second circumference of the converging inlet and the first circumference of the diverging outlet and may structurally connect to two. The throat may be constructed and arranged to allow fluid communication between the converging inlet and the diverging outlet. The second circumference of the converging inlet and the first circumference of the diverging outlet may be equal.

A ninth variation may include an EGR-mixer system as set forth in the first through eighth variations and may include a compressor that may include an inlet and an outlet where the inlet may be in fluid communication with the diverging outlet of the venturi mixer and the outlet may be in fluid communication with a combustion engine. The compressor may be constructed and arranged to flow fluid from the venturi mixer to the combustion engine.

A tenth variation may include an EGR-mixer system that may include a venturi mixer and an EGR valve. The venturi mixer may include a converging inlet, a throat, a diverging outlet, at least one exhaust gas EGR inlet channel, and at least one cooling channel. The EGR valve may include an inlet, a valve, and an outlet. The inlet may be constructed and arranged to receive exhaust gas from a combustion engine and the valve may be positionable to adjust the flow of exhaust gas through the inlet and outlet, and the outlet may be constructed and arranged to allow exhaust gas to flow from the EGR valve to the at least one EGR inlet channel of the venturi mixer. The at least one EGR inlet channel may be constructed and arranged to facilitate the flow of incoming exhaust gas flow from the EGR valve into the venturi mixer. The converging inlet may be constructed and arranged to facilitate intake of air from an air intake and flow said air to the throat. The throat may connect the converging inlet to the diverging outlet. The diverging outlet may be constructed and arranged to facilitate the flow of the exhaust gas and air from the converging inlet and throat to an outlet. The venturi mixer may constructed and arranged to mix exhaust gas and incoming air flow to create an exhaust gas and air mixture and to facilitate condensation of liquid from the exhaust gas and air mixture as said mixtures flows through the venturi mixer.

An eleventh variation may include an EGR-mixer system as set tenth variation where the converging inlet may converge at an angle ranging from about 1 degree to about 30 degrees relative to a longitudinal axis of the through-channel and where the diverging inlet may diverge at an angle ranging from about 1 degree to about 9 degrees relative to the longitudinal axis of the through-channel.

A twelfth variation may include an EGR-mixer system as set forth in the tenth through eleventh variations where the EGR-mixer system may further include a reservoir. The reservoir may comprise an inlet, a fluid reservoir, and a pump. The reservoir may be constructed and arranged to receive condensate from the venturi mixer and may flow said condensate to at least one portion of a motor vehicle to actively cool or heat that portion of the motor vehicle.

A thirteenth variation may include an EGR-mixer system as set forth in the tenth through twelfth variations where the venturi mixer may further include at least one heat transfer fin that may be constructed and arranged to facilitate passive cooling of the venturi mixer and condensation of liquid from the exhaust gas and air mixture as said mixtures flows through the through-channel of the venturi mixer.

A fourteenth variation may include an EGR-mixer system as set forth in the tenth through thirteenth variations where the venturi mixer may further include at least one cooling channel that may be constructed and arranged to facilitate active cooling of the venturi mixer and condensation of liquid from the exhaust gas and air mixture as said mixtures flows through the through-channel of the venturi mixer.

A fifteenth variation may include an EGR-mixer system as set forth in the tenth through fourteenth variations where the venturi mixer may further include at least one cooling channel and the reservoir may be constructed and arranged to receive condensate from the venturi mixer and flow said condensate to the at least one cooling channel constructed and arranged to facilitate active cooling of the venturi mixer.

A sixteenth variation may include an EGR-mixer system that may include a venturi mixer, an EGR valve, an air intake, an air outlet, a reservoir, and a compressor. The venturi mixer may include a converging inlet, a throat, a diverging outlet, at least one exhaust gas EGR inlet channel, and at least one cooling channel. The EGR valve may include an inlet, a valve, and an outlet. The inlet may be constructed and arranged to receive exhaust gas from a combustion a engine, the valve may be positionable to adjust the flow of exhaust gas through the inlet and outlet, and the outlet may be constructed and arranged to allow exhaust gas to flow from the EGR valve to the at least one EGR inlet channel of the venturi mixer. The at least one EGR inlet channel may be constructed and arranged to facilitate the flow of incoming exhaust gas flow from the EGR valve into the venturi mixer. The converging inlet, throat, and diverging outlet may define a through-channel within the venturi mixer. The converging inlet may be constructed and arranged to facilitate intake of air from an air intake and float said air to the throat. The throat may connect the converging inlet to the diverging outlet. The diverging outlet may be constructed and arranged to facilitate the flow of the exhaust gas and air from the converging inlet and throat to the air outlet in fluid communication with the compressor. The venturi mixer may be constructed and arranged to mix exhaust gas and incoming air flow to create an exhaust gas and air mixture and to facilitate condensation of liquid from the exhaust gas and air mixture as said mixture flows through the through-channel of of the venturi mixer. The compressor may include an inlet for receiving the exhaust gas and air mixture from the venturi mixer and an outlet in fluid communication with a combustion engine. The at least one condensate outlet channel may be constructed and arranged to collect and flow condensate to the reservoir and the at least one cooling channel may be constructed and arranged to actively cool the venturi mixer via an active cooling system.

A seventeenth variation may include an EGR-mixer system as set forth in the sixteenth variation where the converging inlet may converge at an angle ranging from about 1 degree to about 30 degrees relative to a longitudinal axis of the through-channel and where the diverging inlet may diverge at an angle ranging from about 1 degree to about 9 degrees relative to the longitudinal axis of the through-channel.

An eighteenth variation may include an EGR-mixer system as set forth in the sixteenth through seventeenth variations further including a reservoir. The reservoir may include an inlet, a fluid reservoir, and a pump; and the reservoir may be constructed and arranged to receive condensate from the venturi mixer and flow said condensate to at least one portion of a motor vehicle to actively cool or heat that portion of the motor vehicle.

A nineteenth variation may include an EGR-mixer system as set forth in the sixteenth through eighteenth variations that may further include at least one heat transfer fin that may be constructed and arranged to facilitate passive cooling of the venturi mixer and condensation of liquid from the exhaust gas and air mixture as said mixtures flows through the through-channel of the venturi mixer.

A twentieth variation may include an EGR-mixer system as set forth in the sixteenth through nineteenth variations that may further include at least one cooling channel that may be constructed and arranged to facilitate active cooling of the venturi mixer and condensation of liquid from the exhaust gas and air mixture as said mixtures flows through the through-channel of the venturi mixer.

A twenty first variation may include an EGR-mixer system as set forth in the sixteenth through twentieth variations that may further include at least one condensate outlet channel valve in the condensate outlet channel comprising a float valve or a check valve.

A twenty second variation may include an EGR-mixer system as set forth in the sixteenth through twenty first variations wherein the condensate outlet channel valve controls flow of condensate in the condensate outlet channel according to a predetermined percentage of total EGR flow rate.

A twenty third variation may include an EGR-mixer system as set forth in the sixteenth through twenty second variations wherein the condensate outlet channel valve comprises a Positive Crankcase Ventilation (PCV) valve that is connected to the air intake system.

The above description of variations of the invention is merely demonstrative in nature and, thus, variations thereof are not to be regarded as a departure from the spirit and scope of the inventions disclosed within this document.

What is claimed is:

1. A product comprising:

an EGR-mixer system comprising a venturi mixer;

the venturi mixer comprising a converging inlet, a throat, and a diverging outlet, a reservoir constructed and arranged to receive condensate from the venturi mixer; the converging inlet, throat, and diverging outlet defining a through-channel within the venturi mixer;

wherein the venturi mixer is constructed and arranged to facilitate the mixing of incoming exhaust gas flow and incoming air flow to create an exhaust gas and air mixture that flows through the through-channel and to facilitate condensation of liquid from the exhaust gas and air mixture as said mixtures flows through the through-channel of the venturi mixer; and wherein at least one condensate outlet channel is constructed and arranged to collect and flow condensate to the reservoir and wherein at least one cooling channel is constructed and arranged to actively cool the venturi mixer via an active cooling system and wherein a condensate outlet channel valve controls flow of condensate in the condensate outlet channel according to a predetermined percentage of total EGR flow rate.

2. A product as set forth in claim 1, wherein:

the converging inlet converges at an angle ranging from 1 degree to 30 degrees relative to a longitudinal axis of the through-channel; and the diverging outlet diverges at an angle ranging from 1 degree to 9 degrees relative to the longitudinal axis of the through-channel.

3. A product as set forth in claim 1, wherein:

the reservoir comprises an inlet; and wherein the reservoir is constructed and arranged to receive condensate from the venturi mixer and flow said condensate to at least one portion of a motor vehicle to actively cool or heat that portion of the motor vehicle.

4. A product as set forth in claim 1, wherein:

the venturi mixer further comprises at least one exhaust gas inlet channel constructed and arranged to facilitate the mixing of incoming exhaust gas flow and incoming air flow to create an exhaust gas and air mixture.

5. A product as set forth in claim 1, wherein:

the venturi mixer further comprises at least one heat transfer fin constructed and arranged to facilitate passive cooling of the venturi mixer and condensation of liquid from the exhaust gas and air mixture as said mixtures flows through the through-channel of the venturi mixer.

6. A product as set forth in claim 1, wherein:

the at least one cooling channel is constructed and arranged to facilitate active cooling of the venturi mixer and condensation of liquid from the exhaust gas and air mixture as said mixtures flows through the through-channel of the venturi mixer.

7. A product as set forth in claim 3, wherein:

the reservoir is constructed and arranged to receive condensate from the venturi mixer and flow said condensate to the at least one cooling channel constructed and arranged to facilitate active cooling of the venturi mixer.

8. A product as set forth in claim 1, wherein:

the converging inlet comprises a first circumference, a second circumference, and an entry cone portion, wherein the first circumference is larger than the second circumference and the entry cone is constructed and arranged to gradually converge from the first circumference to the second circumference along the length of the entry cone;

the diverging outlet comprises a first circumference, a second circumference, and an exit cone portion, wherein the first circumference is smaller than the second circumference and the exit cone is constructed and arranged to gradually diverge from the first circumference to the second circumference along the length of the exit cone;

the throat being located at and connecting the second circumference of the converging inlet to the first circumference of the diverging outlet wherein the throat is constructed and arranged to allow fluid communication between the converging inlet and the diverging outlet; and wherein the second circumference of the converging inlet and the first circumference of the diverging outlet are equal.

9. A product as set forth in claim 1, further comprising:

a compressor comprising an inlet and an outlet wherein the inlet is in fluid communication with the diverging outlet of the venturi mixer, and the outlet is in fluid communication with a combustion engine and wherein the compressor is be constructed and arranged to flow fluid from the venturi mixer to the combustion engine.

10. A product comprising:

an EGR-mixer system comprising a venturi mixer and an EGR valve;

the venturi mixer comprising a converging inlet, a throat, a diverging outlet, at least one exhaust gas EGR inlet channel, a reservoir constructed and arranged to receive condensate from the venturi mixer, and at least one cooling channel;

the EGR valve comprising an inlet, a valve, and an outlet, the inlet constructed and arranged to receive exhaust gas from a combustion a engine, the valve being positionable to adjust the flow of exhaust gas through the inlet and outlet, and the outlet constructed and arranged to allow exhaust gas to flow from the EGR valve to the at least one EGR inlet channel of the venturi mixer;

the at least one EGR inlet channel being constructed and arranged to facilitate the flow of incoming exhaust gas flow from the EGR valve into the venturi mixer;

the converging inlet being constructed and arranged to facilitate intake of air from an air intake and flow said air to the throat;

the throat connecting the converging inlet to the diverging outlet;

the diverging outlet being constructed and arranged to facilitate the flow of the exhaust gas and air from the converging inlet and throat to an outlet; and wherein the venturi mixer is constructed and arranged to mix exhaust gas and incoming air flow to create an exhaust gas and air mixture and to facilitate condensation of liquid from the exhaust gas and air mixture as said mixtures flows through the venturi mixer; and wherein at least one condensate outlet channel is constructed and arranged to collect and flow condensate to the reservoir and the at least one cooling channel is constructed and arranged to actively cool the venturi mixer via an active cooling system and wherein a condensate outlet channel valve controls flow of condensate in the condensate outlet channel according to a predetermined percentage of total EGR flow rate.

11. A product as set forth in claim 10, wherein:

the converging inlet converges at an angle ranging from 1 degree to 30 degrees relative to a longitudinal axis of the through-channel; and the diverging outlet diverges at an angle ranging from 1 degree to 9 degrees relative to the longitudinal axis of the through-channel.

12. A product as set forth in claim 10, wherein:

the reservoir comprises an inlet and a pump; and wherein the reservoir is constructed and arranged to receive condensate from the venturi mixer and flow said condensate to at least one portion of a motor vehicle to actively cool or heat that portion of the motor vehicle.

13. A product as set forth in claim 10, wherein:

the venturi mixer further comprises at least one heat transfer fin constructed and arranged to facilitate passive cooling of the venturi mixer and condensation of liquid from the exhaust gas and air mixture as said mixtures flows through the through-channel of the venturi mixer.

14. A product as set forth in claim 10, wherein:

the at least one cooling channel is constructed and arranged to facilitate active cooling of the venturi mixer and condensation of liquid from the exhaust gas and air mixture as said mixtures flows through the through-channel of the venturi mixer.

15. A product as set forth in claim 12, wherein:

the reservoir is constructed and arranged to receive condensate from the venturi mixer and flow said condensate to the at least one cooling channel constructed and arranged to facilitate active cooling of the venturi mixer.

16. A product comprising:

an EGR-mixer system comprising a venturi mixer, an EGR valve, an air intake, an air outlet, a reservoir, and a compressor;

the venturi mixer comprising a converging inlet, a throat, a diverging outlet, at least one exhaust gas EGR inlet channel, and at least one cooling channel;

the EGR valve comprising an inlet, a valve, and an outlet, the inlet constructed and arranged to receive exhaust gas from a combustion a engine, the valve being positionable to adjust the flow of exhaust gas through the inlet and outlet, and the outlet being constructed and arranged to allow exhaust gas to flow from the EGR valve to the at least one EGR inlet channel of the venturi mixer;

the at least one EGR inlet channel being constructed and arranged to facilitate the flow of incoming exhaust gas flow from the EGR valve into the venturi mixer;

the converging inlet, throat, and diverging outlet defining a through-channel within the venturi mixer;

the converging inlet being constructed and arranged to facilitate intake of air from an air intake and float said air to the throat;

the throat connecting the converging inlet to the diverging outlet;

the diverging outlet being constructed and arranged to facilitate the flow of the exhaust gas and air from the converging inlet and throat to the air outlet in fluid communication with the compressor;

wherein the venturi mixer is constructed and arranged to mix exhaust gas and incoming air flow to create an exhaust gas and air mixture and to facilitate condensation of liquid from the exhaust gas and air mixture as said mixture flows through the through-channel of the the venturi mixer;

the compressor comprising an inlet for receiving the exhaust gas and air mixture from the venturi mixer and an outlet in fluid communication with a combustion engine; and wherein the at least one condensate outlet channel is constructed and arranged to collect and flow condensate to the reservoir and the at least one cooling channel is constructed and arranged to actively cool the venturi mixer via an active cooling system and wherein a condensate outlet channel valve controls flow of condensate in the condensate outlet channel according to a predetermined percentage of total EGR flow rate.

17. A product as set forth in claim 16, wherein:

the converging inlet converges at an angle ranging from 1 degree to 30 degrees relative to a longitudinal axis of the through-channel; and the diverging outlet diverges at an angle ranging from 1 degree to 30 degrees relative to the longitudinal axis of the through-channel.

18. A product as set forth in claim 16, wherein:

the reservoir comprises an inlet, and a pump; and wherein the reservoir is constructed and arranged to receive condensate from the venturi mixer and flow said condensate to at least one portion of a motor vehicle to actively cool or heat that portion of the motor vehicle.

19. A product as set forth in claim 16, wherein:

the venturi mixer further comprises at least one heat transfer fin constructed and arranged to facilitate passive cooling of the venturi mixer and condensation of liquid from the exhaust gas and air mixture as said mixtures flows through the through-channel of the venturi mixer.

20. A product as set forth in claim 16, wherein:

the at least one cooling channel is constructed and arranged to facilitate active cooling of the venturi mixer and condensation of liquid from the exhaust gas and air mixture as said mixtures flows through the through-channel of the venturi mixer.

21. A product as set forth in claim 16, further comprising:

the at least one condensate outlet channel valve in the condensate outlet channel comprising a float valve or a check valve.

22. A product as set forth in claim 16, further comprising:

the at least one condensate outlet channel valve in the condensate outlet channel comprising a Positive Crankcase Ventilation (PCV) valve that is connected to the air intake system.

* * * * *